United States Patent [19]

Shishido et al.

[11] 4,118,445

[45] Oct. 3, 1978

[54] SLIDING THROTTLE VALVE TYPE CARBURETOR

[75] Inventors: Toshimasa Shishido, Tokyo; Mitsuaki Ninomiya, Sagamihara, both of Japan

[73] Assignees: Kabushiki Kaisha Keihinseiki Seisakusho, Kawasaki; Honda Giken Kogyo Kabushiki Kaisha, Tokyo, both of Japan

[21] Appl. No.: 753,379

[22] Filed: Dec. 22, 1976

[30] Foreign Application Priority Data

Mar. 18, 1976 [JP] Japan ..... 51-32620[U]

[51] Int. Cl.[2] ..... F02M 9/06

[52] U.S. Cl. ..... 261/44 B; 261/DIG. 19; 123/97 B

[58] Field of Search ..... 261/44 R, DIG. 19, 44 B; 123/97 B

[56] References Cited

U.S. PATENT DOCUMENTS

| | | | |
|---|---|---|---|
| 3,503,594 | 3/1970 | Goto | 261/DIG. 19 |
| 3,742,922 | 7/1973 | Hisatomi et al. | 261/DIG. 19 |
| 3,756,208 | 9/1973 | Toda et al. | 261/DIG. 19 |
| 3,829,069 | 8/1974 | Hailstone et al. | 261/44 R |
| 3,885,004 | 5/1975 | Marsee | 261/DIG. 19 |

FOREIGN PATENT DOCUMENTS

| | | | |
|---|---|---|---|
| 731,782 | 2/1943 | Fed. Rep. of Germany | 261/44 R |
| 829,678 | 1/1952 | Fed. Rep. of Germany | 261/44 R |
| 484,833 | 9/1953 | Italy | 123/97 B |
| 45-25722 | 8/1970 | Japan | 261/44 R |
| 45-30368 | 10/1970 | Japan | 261/44 R |
| 46-28728 | 8/1971 | Japan | 261/44 R |
| 47-38326 | 9/1972 | Japan | 261/44 R |
| 137,599 | 1/1920 | United Kingdom | 261/44 R |

*Primary Examiner*—Tim R. Miles

*Attorney, Agent, or Firm*—Haseltine, Lake & Waters

[57] ABSTRACT

A carburetor for an automobile engine of a sliding throttle valve type, wherein a throttle valve guide cylinder is connectively provided at one side of an air-intake barrel, in which an air-intake passage is formed and at which a main nozzle is open, and a throttle valve which opens and closes the air-intake passage on the main nozzle is provided inside the throttle valve guide barrel in a sliding manner, the carburetor being further provided with a movable part in the throttle valve, which is capable of increasing an amount of mixture air to be usually adjusted by the throttle valve in such a manner that the movable part may be actuated when a negative pressure of a certain definite value and above develops at the down-stream side of the throttle valve due to reduction in speed of the engine.

4 Claims, 2 Drawing Figures

SLIDING THROTTLE VALVE TYPE CARBURETOR

BACKGROUND OF THE INVENTION

The present invention relates to a sliding throttle valve type carburetor, and, more particularly, it is concerned with the carburetor for an automobile engine, in which a sliding valve such as a piston valve, is used as a throttle valve for an air-intake passageway into the carburetor.

SUMMARY OF THE INVENTION

It is an object of the present invention to provide an improved carburetor for an automobile engine of a sliding throttle valve type.

It is another object of the present invention to provide an improved carburetor for an automobile engine of a construction, in which atmospheric air is prevented, in advance, from becoming contaminated by unburnt components existing in exhaust gas from the engine which are developed due to incomplete combustion of fuel, and which arises from an excessive degree of reduction in the filling efficiency of the mixture air in the carburetor when the engine is to be operated at a reduced speed.

According to the present invention, there is provided a carburetor for an automobile engine of a sliding throttle valve type, wherein a throttle valve guide cylinder is connectively provided at one side of an air-intake barrel, in which an air-intake passageway is formed and to which a main nozzle is open, and a throttle valve which opens and closes the air-intake passage on said main nozzle is provided inside said throttle valve guide cylinder in a sliding manner, said carburetor being further provided in said throttle valve with a movable part which is capable of increasing an amount of mixture air to be usually adjusted by said throttle valve in such a manner that said movable part may be actuated when a negative pressure of a certain definite value and above develops at the down-stream side of said throttle valve due to reduction in speed of the engine.

There has thus been outlined, rather broadly, the more important features of the present invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE ACCOMPANYING DRAWINGS

Specific embodiments of the invention have been chosen for purposes of illustration and description, and are shown in the accompanying drawings, forming a part of the specification, in which:

FIG. 1 is a longitudinal cross-sectional view of a first embodiment of the sliding throttle valve type carburetor according to the present invention; and FIG. 2 is also a longitudinal cross-sectional view of a second embodiment of the sliding throttle valve type carburetor according to the present invention.

DETAILED DESCRIPTION OF PREFERRED EMBODIMENTS

The present invention will now be explained in reference to the couple of preferred embodiments thereof as illustrated in the accompanying drawing.

Figure 1:
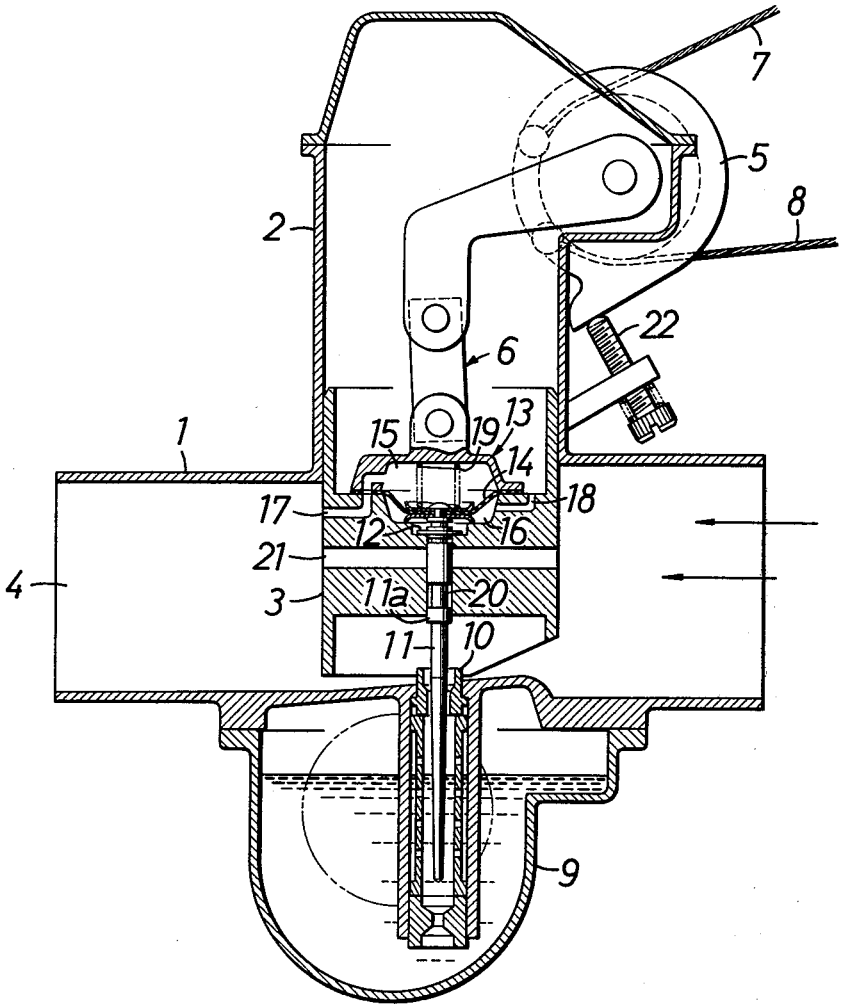

FIG. 1 illustrates the first embodiment of the present invention. In this first embodiment, a piston-shaped throttle valve 3 is fitted, in a sliding manner, inside a throttle valve guide cylinder 2 which is connectively provided on the top side of an air-intake barrel or cylinder 1. The lower part of the throttle valve 3 is caused to be in an air-intake passage 4 of the air-intake barrel 1. This throttle valve 3 is connected to a pulley 5 which is pivotally supported on the upper part of the throttle valve guide cylinder 2 through a link mechanism 6 so that it may move up and down in accordance with forward and backward rotation of the pulley 5. The pulley 5 is caused to rotate in the forward and backward directions by the pulling operation of respective wires 7 and 8 for opening and closing the throttle valve. At the lower side of the air intake barrel 1, there is formed a float chamber 9. A main nozzle 10 which communicates beneath the surface of fuel accommodated in the float chamber 9 is made open to the air-intake passage 4 directly below the throttle valve 3, and a jet needle 11 to be inserted into the main nozzle 10 is inserted into the throttle valve 3 in a manner freely moving up and down therealong. At the top end of the jet needle 11, there is provided a stopper ring 12 which contacts the upper surface of the throttle valve 3. On the top surface of the throttle valve 3, there is provided a negative pressure actuator 13, and the topmost end of the jet needle 11 is connected to a diaphragm 14 accommodated inside the negative pressure actuator 13. The interior of the negative pressure actuator 13 is divided by the diaphragm 14 into a negative pressure chamber 15 and an atmospheric chamber 16. The negative pressure chamber 15 communicates with the air-intake passageway 4 at its downstream (the left side as viewed from the surface of the drawing) from the throttle valve 3 through an air vent 17. On the other hand, the atmospheric chamber 16 communicates with the interior of the throttle valve guide cylinder 2 through another air vent 18. A return spring 19 which urges the diaphragm 14 to the side of the atmospheric chamber 16 is provided in the negative pressure chamber in a compressed state. The portion of the jet needle 11 where it slidingly contacts the throttle valve 3 is constructed in the form of a spool valve **11*a* having an annular groove 20 therearound. A secondary air passage 21 to be opened and closed by this spool valve 11*a* is perforated in the throttle valve 3. Reference numeral 22 designates an idle stopper screw which is capable of adjusting the degree of idle opening in the throttle valve 3**.

In this embodiment, the jet needle 11 is usually maintained at the lower limit position as illustrated in the drawing, where the stopper ring 12 and the throttle valve 3 are mutually contacted by the spring force of the return spring 19, by which the opening area of the main nozzle 10 can be adjusted in the same manner as in the case of the conventional carburetor of this type. On the other hand, the secondary air passageway 21 is closed by the spool valve **11*a*. This state does not change at all during the idling, accelerating, and slowing-down operations of the engine, wherein no excessive degree of negative pressure develops at the downsteam side of the throttle valve 3. Accordingly, it becomes possible to adjust the concentration and the flow rate of the mixture air which is produced in the air-intake passageway 4 in such a manner that it may be adapted to each of the abovementioned modes of the engine operation through the adjustment of the degree of opening of the throttle valve 3** in the same way as in the case of the conventional carburetor.

However, with a view to attaining abrupt reduction in speed of the engine from its operational state of high power output, when the throttle valve 3 is abruptly closed to its degree of opening for the idling operation from a high degree of opening, there inevitably develops an excessive degree of negative pressure at the down-stream side of the throttle valve 3. This negative pressure is transmitted to the negative pressure chamber 15 through the air vent 17 to cause the diaphragm 14 to move upwardly against the spring force of the return spring 19, whereby the jet needle 11 is moved upward relative to the throttle valve 3. As the result of this, the opening area of the main nozzle 10, in spite of the throttle valve 3 being closed to its degree of opening for the idling operation, becomes broader than at the time of the idling operation, whereby the amount of fuel ejection increases. At the same time, the annular groove 20 of the spool valve ll*a* meets the secondary air passageway 21 to bring it to a communicative state, on account of which secondary air flows into the down-stream of the air-intake passageway 4 through the secondary air passageway 21, and excessive reduction in the filling or charging efficiency of the mixture air in the engine becomes corrected thereby.

Figure 2:
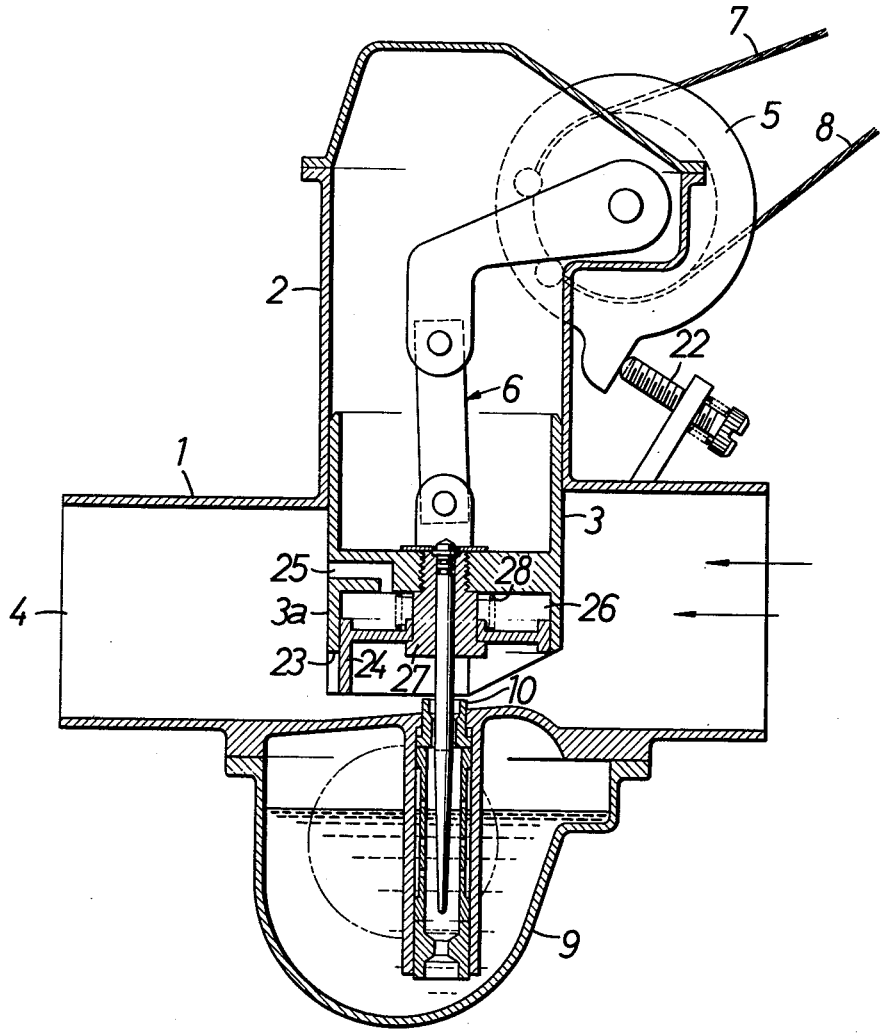

FIG. 2 shows the second embodiment of the carburetor according to the present invention. In this second embodiment, the carburetor is so constructed that a cylindrical part 3*a*, the bottom surface of which is open, is formed at the lower end part of the throttle valve 3. An air passage groove 23 is formed at the bottom surface on the rear wall of the cylindrical part 3*a*, and a piston-shaped valve body 24 which opens and closes the bottom open surface of the cylindrical part 3*a* is fitted into the groove 23 in a sliding manner. On the top side of this valve body 24, there is formed a negative pressure chamber 26 which communicates with the downstream side of the throttle valve 3 through an air vent 25. Also, a return spring 28, which urges the valve body 24 toward a lower limit stopper 27 fixedly secured to the throttle valve 3, is provided in the negative pressure chamber 26 in a compressed state. The remaining parts of the carburetor in this second embodiment are not much different from the conventional carburetor of this type, so that those component parts having identical functions as those of the first embodiment shown in FIG. 1 of the drawing are designated by the same reference numerals and symbols.

In this second embodiment, the valve body 24 is usually maintained at the lower limit position by the spring force of the return spring 28 to thereby close the air passage groove 23, so that the function of the throttle valve 3 is not different from that of the carburetor in general so far as it is in this condition. However, when such excessive negative pressure develops at the downstream side of the throttle valve 3 due to abrupt speed reduction in the engine, the negative pressure is transmitted to the negative pressure chamber 26 from the air vent 25, and pulls up the valve body 24 against the spring force of the return spring 28 to thereby open the air passage groove 23. As the result of this, the quantity of air passage over the main nozzle 10 increases in spite of the throttle valve 3 being closed to its degree of opening for the idling operation with the consequent increase in the quantity of fuel ejection from the main nozzle 10, by the increases of which the excessive reduction in the filling efficiency of the mixture air in the engine can be rectified as is the case with the aforedescribed first embodiment.

As stated in the foregoing, the present invention is so designed that, in the carburetor of a sliding throttle valve type, when the excessive degree of negative pressure develops at the down-stream side of the throttle valve by the abrupt reduction in speed of the engine, the movable part provided in the throttle valve is actuated to increase the quantity of the mixture air which is usually adjusted by the throttle valve, so that, even when a driver performs the abrupt closing operation of the throttle valve without increasing or decreasing whatsoever the valve closing speed at the time of speed reducing operation, the excessive reduction in the filling efficiency of the mixture air in the engine is automatically rectified, and satisfactory combustion of fuel is continued. In consequence of this, contamination of air due to the unburnt component in the exhaust gas from the engine can be prevented before it actually takes place.

Although the present invention has been described in detail in the foregoing in reference to a few preferred embodiments thereof, it should be noted that these embodiments are merely illustrative and not restrictive to the present invention and that any change and modification may be made by those skilled in this field of art within the purview of the present invention as set forth in the appended claims.

What is claimed is:

1. A carburetor for internal combustion engines of a sliding throttle valve type, comprising: an air intake barrel having an air-intake passage therein, a main nozzle arranged to open into said air-intake passage, a guide cylinder arranged at one side of said air-intake barrel in opposite relation with said main nozzle, a throttle valve slidably fitted in said guide barrel and operable to open and close said air-intake passage, a movable element mounted in said throttle valve for vertical sliding movement relative thereto and operable to control mixture supply from said main nozzle to said air-intake passage, and means for controlling vertical movement of said movable element relative to said throttle valve for displacing said movable element, in response to a negative pressure of a predetermined value and above in said air-intake passage downstream of said throttle valve generated due to deceleration of an engine associated with said carburetor, relative to said throttle valve in a direction away from said main nozzle so as to increase the amount of mixture fed from said main nozzle to said air-intake passage, said movable element comprising a jet needle having an upper portion slidably fitted in said throttle valve and a tapered lower portion inserted into said main nozzle, said means for controlling vertical movement of said movable element comprising a negative pressure responsive device operatively connected with said jet needle, said throttle valve having a secondary air passage formed therethrough for communication between the upstream side and the downstream side of said air-intake passage, said secondary passage being normally closed and being opened in accordance with upward movement of said jet needle relative to said throttle valve, said jet needle including a cylindrical upper portion slidably fitted in said throttle valve, said cylindrical portion being provided at its periphery with an annular groove which is normally out of register with said secondary air passage, said annular groove being placed into register with said secondary air passage to open the latter when said jet needle has been moved upwardly to a predetermined extent relative to said throttle valve.

2. A carburetor as claimed in claim 1, in which said negative pressure responsive device comprises a diaphragm defining on opposite sides thereof, a negative pressure chamber and an atmospheric pressure chamber, said negative pressure chamber communicating with the downstream side of said air-intake passage, said atmospheric pressure chamber communicating with ambient atmoshphere, said jet needle being secured at its upper end to said diaphragm.

3. A carburetor for internal combustion engines of a sliding throttle valve type, comprising: an air intake barrel having an air-intake passage therein, a main nozzle arranged to open into said air-intake passage, a guide cylinder arranged at one side ofsaid air-intake barrel in opposite relation with said main nozzle, a throttle valve slidably fitted in said guide barrel and operable to open and close said air-intake passage, a movable element mounted in said throttle valve for vertical sliding movement relative thereto and operable to control mixture supply from said main nozzle to said air-intake passage, means for controlling vertical movement of said movable element relative to said throttle valve for displacing said movable element, in response to a negative pressure of a predetermined value and above in said air-intake passage downstream of said throttle valve generated due to deceleration of an engine associated with said carburetor, relative to said throttle valve in a direction away from said main nozzle so as to increase the amount of mixture fed from said main nozzle to said air-intake passage, a jet needle mounted at one end to said throttle valve with its other end inserted in said main nozzle, said throttle valve being provided at its lower end with an air passage groove in opposite facing relation with said main nozzle, said groove extending across said throttle valve, said movable element comprising a valve body fitted in said throttle valve for vertical sliding movement relative thereto, said valve body being normally urged to close said air passage groove and being moved by suction upwardly relative to said throttle valve to open said air passage groove when a negative pressure in said air-intake passage downstream of said throttle valve exceeds a certain prescribed level due to deceleration of the associated engine.

4. A carburetor as claimed in claim 3, in which a negative pressure chamber is defined in said throttle valve by said valve body on the side thereof remote from said main nozzle, said negative pressure chamber being in communication with said air-intake passage downstream of said throttle valve.

* * * * *